US012807446B2

(12) United States Patent
Hayashi

(10) Patent No.: US 12,807,446 B2
(45) Date of Patent: Nov. 24, 2026

(54) PAPER WINDER AND PAPER WINDING METHOD

(71) Applicant: TMEIC CORPORATION, Tokyo (JP)

(72) Inventor: Yasuhiro Hayashi, Tokyo (JP)

(73) Assignee: TMEIC CORPORATION, Tokyo (JP)

( * ) Notice: Subject to any disclaimer, the term of this patent is extended or adjusted under 35 U.S.C. 154(b) by 0 days.

(21) Appl. No.: 18/857,244

(22) PCT Filed: Mar. 16, 2023

(86) PCT No.: PCT/JP2023/010427

§ 371 (c)(1),
(2) Date: Oct. 16, 2024

(87) PCT Pub. No.: WO2024/189922

PCT Pub. Date: Sep. 19, 2024

(65) Prior Publication Data

US 2025/0263261 A1 Aug. 21, 2025

(51) Int. Cl.

| | |
|---|---|
| ***B65H 19/22*** | (2006.01) |
| ***B65H 19/26*** | (2006.01) |
| ***B65H 23/198*** | (2006.01) |

(52) U.S. Cl.

CPC ..... *B65H 19/2207* (2013.01); *B65H 19/265* (2013.01); *B65H 23/198* (2013.01);

(Continued)

(58) Field of Classification Search

CPC .. B65H 18/10; B65H 18/0212; B65H 19/265; B65H 19/2207; B65H 19/2215; B65H 23/198

See application file for complete search history.

(56) References Cited

U.S. PATENT DOCUMENTS 4,798,350 A * 1/1989 Jorgensen ..... B65H 19/267 242/533.4
6,003,421 A * 12/1999 Milich ..... B26D 7/2628 83/13

(Continued)

FOREIGN PATENT DOCUMENTS

JP H02-123078 A 5/1990
JP H02-249848 A 10/1990

(Continued)

OTHER PUBLICATIONS

International Search Report and Written Opinion mailed on May 30, 2023, received for PCT Application PCT/JP2023/010427, filed on Mar. 16, 2023, 15 pages including English Translation.

(Continued)

*Primary Examiner* — Sang K Kim
(74) *Attorney, Agent, or Firm* — XSENSUS LLP

(57) ABSTRACT

In a rotation control for a first motor and a second motor, after, according to a turning of a second arm, completion of a winding of a paper by a first winding core and after a position of a second winding core has reached a position where the paper should be wound, during an operation of a traverse cutter that cuts the paper near the second winding core, when a torque value of the second motor is equal to or larger than a torque reference value, a paper winder switches a control mode of the second motor from speed control to torque control and perform tension correction control for adjusting the torque value of the second motor such that tension of the paper falls within a target range.

20 Claims, 5 Drawing Sheets

(52) U.S. Cl.
CPC ..... *B65H 2301/41392* (2013.01); *B65H 2301/41461* (2013.01); *B65H 2701/19* (2013.01)

(56) References Cited

U.S. PATENT DOCUMENTS

| | | | | |
|---|---|---|---|---|
| 8,740,128 | B2 * | 6/2014 | Oravits | B65H 35/04 242/527.2 |
| 9,376,283 | B2 * | 6/2016 | Oravits | B65H 19/26 |

FOREIGN PATENT DOCUMENTS

| | | | |
|---|---|---|---|
| JP | H10-035969 | A | 2/1998 |
| JP | H11-226640 | A | 8/1999 |
| JP | 2015-004817 | A | 1/2015 |
| JP | 2017-052571 | A | 3/2017 |

OTHER PUBLICATIONS

International Preliminary Report on Patentability mailed Sep. 25, 2025 in International Patent Application No. PCT/JP2023/010427.
Office Action issued on Oct. 15, 2024, in corresponding Japanese patent Application No. 2024-532845, 4 pages.
Office Action issued Apr. 20, 2026 in Korean patent application No. 10-2024-7032278., 9 pages.

* cited by examiner

PAPER WINDER AND PAPER WINDING METHOD

CROSS-REFERENCE TO RELATED APPLICATION

This application is a national stage application, pursuant to 35 U.S.C. § 371, of International Patent Application No. PCT/JP2023/010427, filed Mar. 16, 2023, the entire contents of which are incorporated herein by reference.

TECHNICAL FIELD

The present disclosure relates to a paper winder.

BACKGROUND ART

PTL 1 discloses a technique for continuously winding a web, which is a belt-shaped sheet-like object such as paper of a film, with a plurality of winding rolls. In this related art, the web is cut when the winding roll on which the web should be wound is replaced. Specifically, the web is cut in a state in which the web is in contact with the outer circumferential surface of a winding core on which the web should be wound anew.

CITATION LIST

Patent Literature

[PTL 1] JP 2015-048173 A

SUMMARY OF THE INVENTION

Problem to be Solved by the Invention

Incidentally, when paper is continuously wound by a plurality of winding cores, a traverse cutter is sometimes used for cutting paper when a winding roll is replaced after the winding of the paper by the winding cores has been completed. When the paper is cut by the traverse cutter, a state occurs in which both of the winding roll and a new winding core that should wind the paper wind the paper.

In this case, when an operation state is not suitable for the new winding core to wind the paper when the paper is cut by the traverse cutter, it is likely that creases, paper winding jumble, and the like occur on the paper wound by the new winding core.

An object of the present disclosure is to provide a technique that can improve stability of paper winding by a new winding core when a winding roll is replaced.

Means for Solving the Problems

A first aspect of the present disclosure relates to a paper winder. The paper winder that winds a paper includes a first winding core that is provided in a first arm turning centering on a rotating shaft and on which the paper should be wound, a first motor that drives the first winding core, a second winding core that is provided in a second arm turning centering on the rotating shaft and on which the paper should be wound next to the first winding core, a second motor that drives the second winding core, and a controller that performs rotation control for the first motor and the second motor. The controller, in the rotation control, after completion of the winding of the paper by the first winding core and after, according to the turning of the second arm, a position of the second winding core has reached a position where the paper should be wound, during an operation of a traverse cutter that cuts the paper near the second winding core, when a torque value of the second motor is equal to or larger than a torque reference value, switches a control mode of the second motor from speed control to torque control and perform tenson correction control for adjusting the torque value of the second motor such that tension of the paper falls within a target range.

A second aspect of the present disclosure further includes the following characteristics in addition to the first aspect. The torque reference value is a torque value of the first motor at a time when the tension of the paper at a time of the winding of the paper by the first winding core is within the target range.

A third aspect of the present disclosure further includes the following characteristics in addition to the second aspect. The torque reference value is further a value obtained by adding at least a mechanical loss of the second motor to the torque value of the first motor.

A fourth aspect of the present disclosure further includes the following characteristics in addition to the third aspect. The mechanical loss is periodically updated during the driving of the second motor.

A fifth aspect of the present disclosure further includes the following characteristics in addition to the first aspect. In the rotation control, after switching the control mode of the second motor from the speed control to the torque control and after completion of the operation of the traverse cutter, the controller further sets a control mode of the first motor to stop the driving of the first motor.

A sixth aspect of the present disclosure relates to a paper winding method. The paper winding method includes: determining, after completion of winding of the paper by a first winding core that is provided in a first arm turning centering on a rotating shaft and on which the paper should be wound and after a position of a second winding core that is provided in a second arm turning centering on the rotating shaft and on which the paper should be wound next to the first winding core has reached a position where the paper should be wound, during an operation of a traverse cutter that cuts the paper near the second winding core, whether a torque value of a second motor that drives the second winding core is equal to or larger than a torque reference value; switching a control mode of the second motor from speed control to torque control when it is determined that the torque value of the second motor is equal to or larger than the torque reference value; and performing tension correction control for adjusting the torque value of the second motor such that tension of the paper falls within a target range.

Advantageous Effects of the Invention

According to the present disclosure, when the torque value of the second motor is equal to or larger than the torque reference value at the operation time of the traverse cutter that cuts the paper, the control mode of the second motor is switched from the speed control to the torque control and the tension correction control for adjusting the torque value of the second motor such that the tension of the paper falls within the target range is performed. Consequently, it is possible to improve stability of paper winding by a new winding core when a winding roll is replaced.

DESCRIPTION OF EMBODIMENTS

Figure 1A:
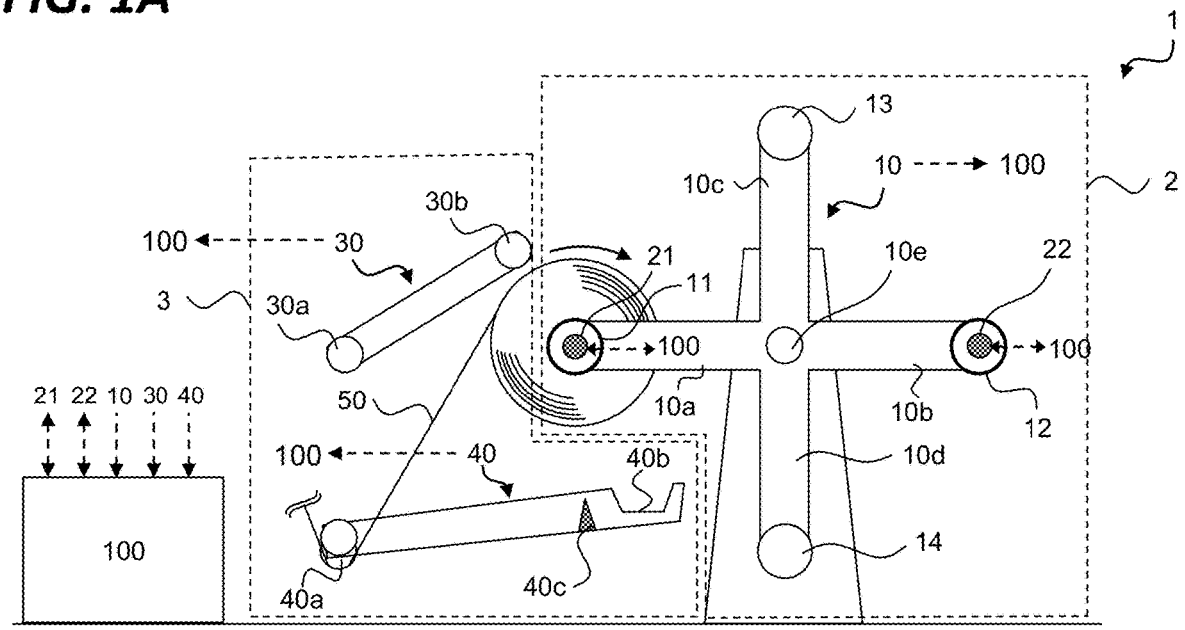
FIG. 1 is a diagram for explaining an outline of a paper winder according to an embodiment.

A paper winder and a paper winding method according to an embodiment of the present disclosure are explained with reference to the accompanying drawings. Elements common in the figures are denoted by the same reference numerals and signs and redundant explanation of the elements is omitted.

1. Overview

1-1. Configuration of a Paper Winder

FIG. 1 is a diagram for explaining an overview of a paper winder 1 according to an embodiment. The paper winder 1 is a turret-type device that continuously winds paper 50 with a plurality of winding cores. The paper 50 is, for example, thick paper having thickness of 800 μm or the like. The paper winder 1 includes a paper winding mechanism unit 2, a paper cutting unit 3, and a controller 100.

The paper winding mechanism unit 2 includes an arm unit 10 (a first arm 10*a*, a second arm 10*b*, a third arm 10*c*, and a fourth arm 10*d*). Each of the arms has a mechanism of turning in at least one direction centering on a rotating shaft 10*e* provided at one end of the arm. These arms may have cross-shaped structure as shown in FIG. 1A.

Each of the arms repeatedly performs turning at a predetermined angle at every predetermined timing after an operation start of the paper winder 1. Alternatively, the arm receives a turning instruction by the controller 100 explained below and performs the turning at the predetermined angle.

A first winding core 11 is provided at the other end of the first arm 10*a*. A second winding core 12 is provided at the other end of the second arm 10*b*. A guide roller 13 is provided at the other end of the third arm 10*c*. A guide roller 14 is provided at the other end of the fourth arm 10*d*.

The first winding core 11 is a winding core on which the paper 50 should be wound. The second winding core 12 is a winding core on which the paper 50 should be wound next to the first winding core 11. For example, as shown in FIG. 1A, the second winding core 12 is located on the opposite side of the first winding core 11 via the rotating shaft 10*e*. When the position of one winding core of the first winding core 11 and the second winding core 12 is a position where the paper 50 should be wound, the paper 50 is wound by the winding core. The position where the paper 50 should be wound is, for example, the position of the first winding core 11 shown in FIG. 1A.

After completion of the winding of the paper 50 by the first winding core 11 and in a period from when, according to the turning of the second arm 10*b*, the position of the second winding core 12 has reached the position where the paper 50 should be wound until the paper 50 is cut, the guide roller 14 guides the paper 50 to be wound by the first winding core 11. Although not illustrated, after the completion of the winding of the paper 50 by the second winding core 12 and in a period from when, according to the turning of the first arm 10*a*, the position of the first winding core 11 has reached again the position where the paper 50 should be wound until the paper 50 is cut, the guide roller 13 guides the paper 50 to be wound by the second winding core 12.

The paper winding mechanism unit 2 further includes a first motor 21 and a second motor 22. The first motor 21 is a motor that drives the first winding core 11. The first motor 21 is fixed and attached to the first winding core 11. The second motor 22 is a motor that drives the second winding core 12. The second motor 22 is fixed and attached to the second winding core 12. The first motor 21 and the second motor 22 receive a command by the controller 100 explained below and perform a driving start or a driving stop.

When the position of one winding core of the first winding core 11 and the second winding core 12 is the position where the paper 50 should be wound, the winding of the paper 50 by the winding core is realized by driving a motor corresponding to the winding core.

The paper cutting unit 3 includes a first touch arm 30 and a second touch arm 40. The first touch arm 30 is a mechanical device for, such that the second winding core 12 can wind the cut paper 50, pressing the paper 50 against the outer circumferential surface of the second winding core 12 when the paper 50 is cut.

The first touch arm 30 includes a mechanism that turns based on a rotating shaft 30*a* provided at one end of the first touch arm 30. Here, a motion of the first touch arm 30 turning in the clockwise direction at the viewpoint of FIG. 1 is referred to as forward movement and a motion of the first touch arm 30 turning in the counterclockwise direction at the viewpoint of FIG. 1 is referred to as backward movement. The first touch arm 30 moves forward before the paper 50 is cut and moves backward after the paper 50 is cut.

Figure 1B:
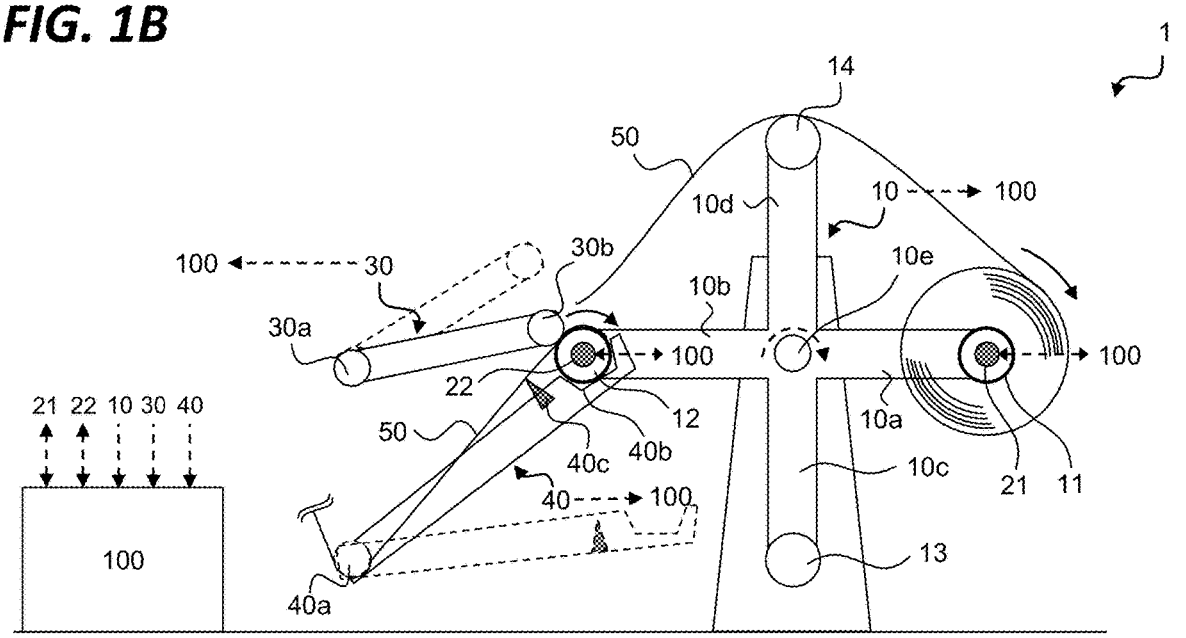

Specifically, as shown in FIG. 1B, the first touch arm 30 moves forward simultaneously with completion of an operation of the paper winding mechanism unit 2. The first touch arm 30 moves backward simultaneously with completion of cutting of the paper 50 by a traverse cutter 40*c* explained below.

When moving forward, the first touch arm 30 presses the paper 50 against the outer circumferential surface of the second winding core 12 with a nip roll 30*b* provided at the other end of the first touch arm 30. Consequently, the second winding core 12 can wind the cut paper 50.

The second touch arm 40 is a mechanical device that cuts the paper 50. The second touch arm 40 includes a mechanism that turns based on a rotating shaft 40*a* provided at one end of the second touch arm 40. A motion of the second touch arm 40 turning in the counterclockwise direction at the viewpoint of FIG. 1 is referred to as forward movement and a motion of the second touch arm 40 turning in the clockwise direction at the viewpoint of FIG. 1 is referred to as backward movement. The second touch arm 40 moves forward before the paper 50 is cut and moves backward after the paper 50 is cut.

Specifically, as shown in FIG. 1B, the second touch arm 40 moves forward simultaneously with the completion of the operation of the paper winding mechanism unit 2. The second touch arm 40 moves backward simultaneously with the completion of the cutting of the paper 50 by the traverse cutter 40*c* explained below.

The second touch arm 40 includes a winding core fixture 40*b* in which the second winding core 12 provided at the other end of the second touch arm 40 can be fit and fixed. The second winding core 12 is fixed by the winding core fixture 40*b* when the paper 50 is cut.

The second touch arm 40 includes the traverse cutter 40*c* provided between one end of the second touch arm 40 and the other end of the second touch arm 40. The traverse cutter 40*c* is a cutting machine that cuts the paper 50. The traverse cutter 40*c* is housed in the second touch arm 40 except when cutting the paper 50 and is used only when cutting the paper 50. An image during the use of the traverse cutter 40*c* is represented, for example, as shown in FIG. 1B.

The traverse cutter 40*c* cuts the paper 50 near the second winding core 12 after the second winding core 12 has reached the position where the paper 50 should be wound. For example, as shown in FIG. 1B, a position where the paper 50 is cut is a position between one end (the rotating shaft 40*a*) of the second touch arm 40 and the other end (the winding core fixture 40*b*) of the second touch arm 40 and near the second winding core 12. An overview of a method of cutting the paper 50 by the traverse cutter 40*c* is explained below.

The controller 100 is a controller that performs rotation control for the first motor 21 and the second motor 22. The controller is, for example, a PLC (Programmable Logic Controller). The controller 100 includes a driver that drives the first motor 21 and the second motor 22. Further, the controller 100 stores a paper winding program (not shown). The controller 100 executes the paper winding program, whereby a function of the rotation control for the first motor 21 and the second motor 22 is realized.

The controller 100 is connected to each of the first motor 21, the second motor 22, the arm unit 10, the first touch arm 30, and the second touch arm 40. The controller 100 and the respective kinds of equipment are respectively connected by, for example, cables.

The controller 100 receives at least a turning start flag of the second arm 10*b* from the arm unit 10. The controller 100 receives at least a forward movement start flag of the first touch arm 30 from the first touch arm 30. Further, the controller 100 receives at least a backward movement start flag of the second touch arm 40 from the second touch arm 40. Details of the rotation control for the first motor 21 and the second motor 22 by the controller 100 are explained below.

1-2. Operation Example of the Traverse Cutter

Figure 2:
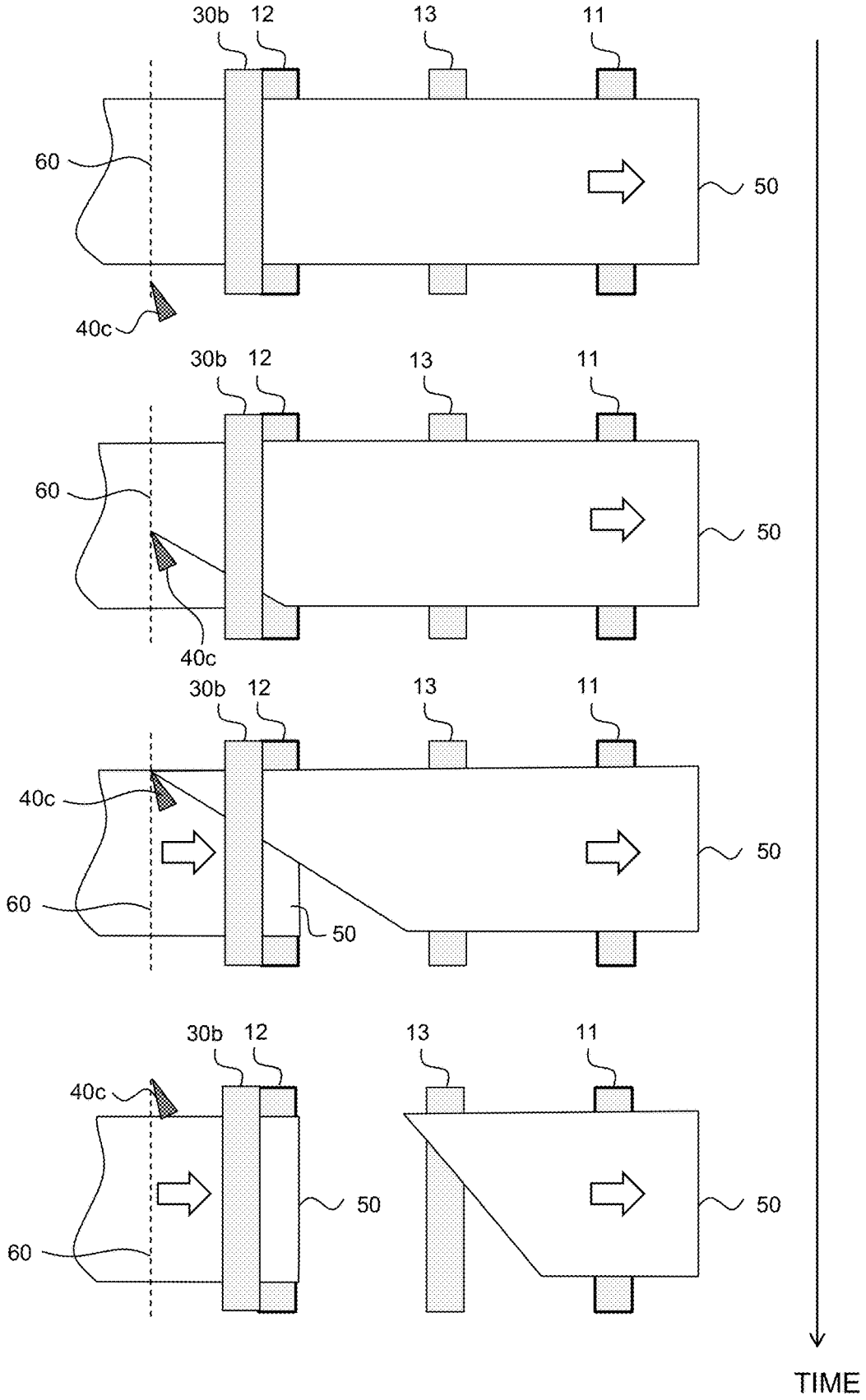
FIG. 2 is a diagram for explaining an outline of the paper winder according to the embodiment.

FIG. 2 is a diagram for explaining an overview of a method of cutting by the traverse cutter 40*c* in the paper winder 1 according to the embodiment. Specifically, in FIG. 2, an operation example of the traverse cutter 40*c* that cuts the paper 50 near the second winding core 12 after the completion of the winding of the paper 50 by the first winding core 11 and after, according to the turning of the second arm 10*b*, the position of the second winding core 12 has reached the position where the paper 50 should be wound is shown in time series.

As shown in FIG. 2, the traverse cutter 40*c* cuts the paper 50 in a direction (a cutting direction) orthogonal to the longitudinal direction of the paper 50 in a state in which the paper 50 is pressed against the outer circumferential surface of the second winding core 12 by the nip roll 30*b*. Since cutting speed of the traverse cutter 40*c* is adjusted to winding speed of the paper 50, the paper 50 being wound by the first winding core 11 is cut by the traverse cutter 40*c* at a slant angle of 45 degrees with respect to a winding direction.

In the traverse cutter 40*c*, a movable range 60 is provided with respect to the cutting direction. As shown in FIG. 2, the traverse cutter 40*c* cuts the paper 50 according to the movable range 60. Note that, when the width of the paper 50 is represented as W [m] and the speed of the paper 50 being wound by the first winding core 11 is represented as V [m/min], a cutting time of the traverse cutter 40*c* is represented by the following Expression (1).

[Math. 1]

$$\frac{W}{V} \tag{1}$$

For example, when the width of the paper 50 is 2.01 [m] and the speed of the paper 50 is set to 20 [m/min], the cutting time of the traverse cutter 40*c* is 6.03 [s].

After the cutting of the paper 50 by the traverse cutter 40*c*, two separated pieces of the paper 50 are respectively wound by the first winding core 11 and the second winding core 12. Consequently, the winding roll after the completion of the winding of the paper 50 by the first winding core 11 can be replaced in a state in which the paper winder 1 is continuously operated.

2. Specific Example

2-1. An Example of Rotation Control for the Motors

Figure 3:
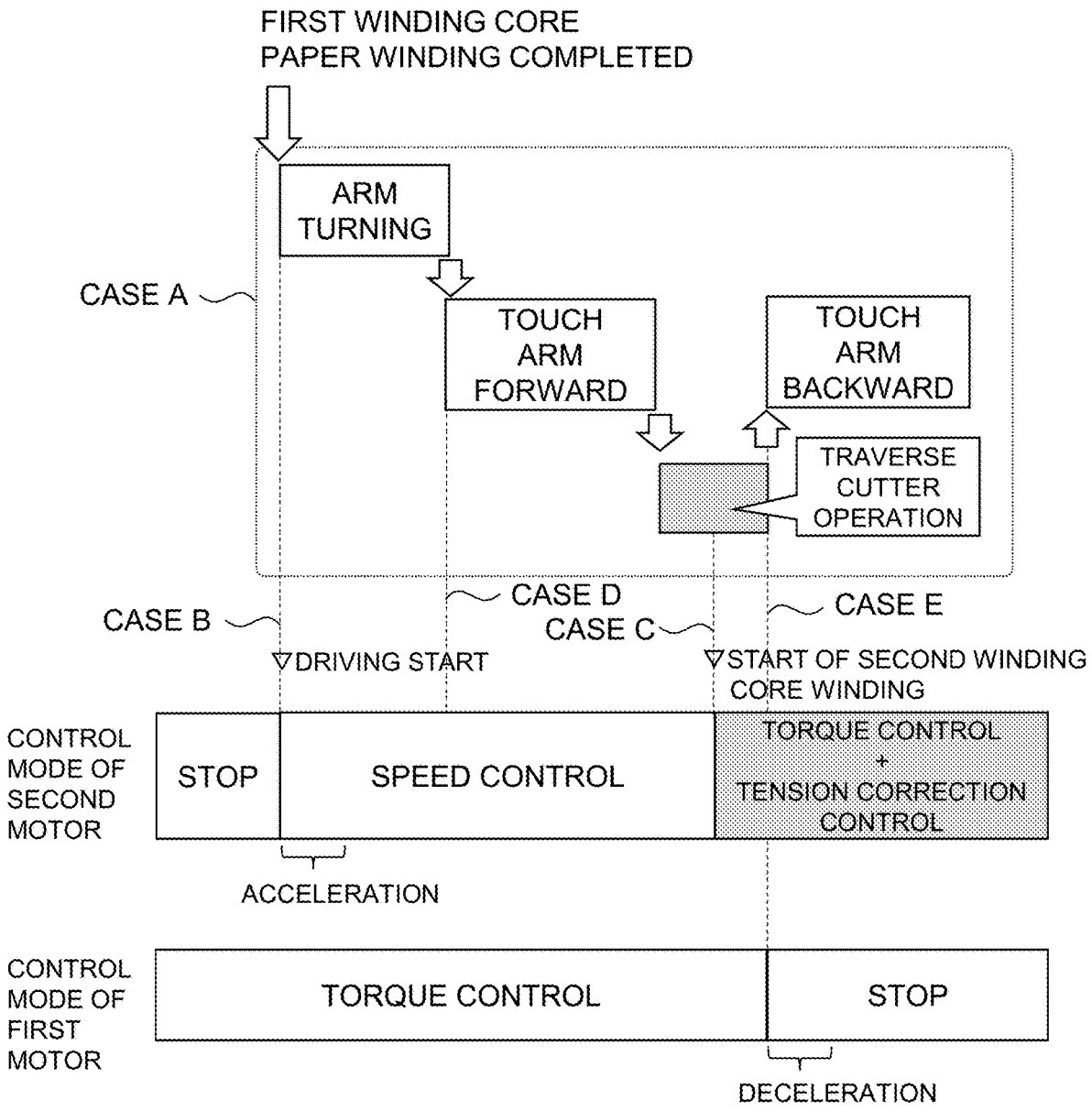
FIG. 3 is a diagram for explaining a specific example of the paper winder according to the embodiment.

FIG. 3 is a diagram for explaining a specific example of the paper winder 1 according to the embodiment. Specifically, FIG. 3 shows an example of rotation control for the first motor 21 and the second motor 22 in the controller 100 of the paper winder 1. Note that, in processing of a portion shown in a case A of FIG. 3, a mechanical operation is performed in a chain reaction manner and control by the controller 100 is not performed. Based on this, an example of rotation control for the first motor 21 and the second motor 22 by the controller 100 is explained below.

At timing shown in a case B of FIG. 3, the controller 100 receives, from the arm unit 10, the turning start flag of the second arm 10*b* after the completion of the winding of the paper 50 by the first winding core 11.

The controller 100 sets a control mode of the second motor 22 to drive the second motor 22. Specifically, the controller 100 sets the control mode of the second motor 22 to speed control. The speed control means controlling rotating speed of a motor to drive the motor within a target speed range.

When the control mode of the second motor 22 is set to the speed control, a driving state of the second motor 22 is transitioned in the order of a stop state and an acceleration state. Consequently, the second motor 22 can be driven. Thereafter, the second motor 22 is controlled such that the second motor 22 is driven at speed within the target speed range.

The controller 100 switches the control mode of the second motor 22 from speed control to torque control at timing during the operation of the traverse cutter 40*c* and when a torque value of the second motor 22 satisfies a predetermined condition. The torque control means controls a motor to drive at generated torque within a range of target torque.

The timing during the operation of the traverse cutter 40*c* and when the torque value of the second motor 22 satisfies the predetermined condition is, for example, a position shown in a case C of FIG. 3. The predetermined condition means a condition that the torque value of the second motor 22 is equal to or larger than a torque reference value. Details of setting of the torque reference value are explained below.

Here, a method of the controller 100 grasping the timing during the operation of the traverse cutter 40*c* is conceived. A time period during the operation of the traverse cutter 40*c* is calculated by Expression (1) described above. Therefore, the controller 100 has to grasp only operation start time of the traverse cutter 40*c*. The operation start time of the traverse cutter 40*c* is, for example, time obtained by adding a predetermined time period (a first time period) to turning start time (timing shown in the case B of FIG. 3) of the second arm 10*b* after the completion of the winding of the paper 50 by the first winding core 11. Alternatively, the operation start time of the traverse cutter 40*c* is time obtained by adding a predetermined time period (a second time period) to forward movement start time (timing shown in a case D of FIG. 3) of the first touch arm 30.

Note that the first time period and the second time period may be information concerning predetermined time periods or may be information concerning time periods acquired by measurement.

Based on this, the controller 100 sets, as the turning start time of the second arm 10*b*, the turning start flag of the second arm 10*b* received from the second arm 10*b*. Alternatively, the controller 100 sets, as the forward movement start time of the first touch arm 30, the forward movement start flag of the first touch arm 30 received from the first touch arm 30. The controller 100 adds the first time period to the turning start time of the second arm 10*b*. Alternatively, the controller 100 adds the second time period to the forward movement start time of the first touch arm 30. Consequently, the controller 100 can grasp the operation start time of the traverse cutter 40*c*.

Further, the controller 100 performs tension correction control for the second motor 22 at the timing during the operation of the traverse cutter 40*c* and when the torque value of the second motor 22 satisfies the predetermined condition explained above. That is, at the timing, the controller 100 switches the control mode of the second motor 22 from the speed control to the torque control and performs the tension correction control for the second motor 22. The tension correction control means adjusting a torque value of a motor such that the tension of the paper 50 falls within a target range.

After switching the control mode of the second motor 22 from the speed control to the torque control and after the completion of the operation of the traverse cutter 40*c*, the controller 100 sets a control mode of the first motor 21 to stop the driving of the first motor 21. Specifically, the controller 100 switches the control mode of the first motor 21 from torque control to stop. When the control mode of the first motor 21 is set to the stop, a driving state of the first motor 21 is transitioned in the order of a deceleration state and a stop state. Consequently, the driving of the first motor 21 can be stopped.

Here, a method of the controller 100 grasping operation completion time of the traverse cutter 40*c* is conceived. The operation completion time of the traverse cutter 40*c* may be, for example, backward movement start time (timing shown in a case E of FIG. 3) of the second touch arm 40. The controller 100 sets, as the backward movement start time of the second touch arm 40, the backward movement start flag of the second touch arm 40 received from the second touch arm 40. Consequently, the controller 100 can grasp the operation completion time of the traverse cutter 40*c*.

2-2. Setting Example of the Torque Reference Value

Figure 4:
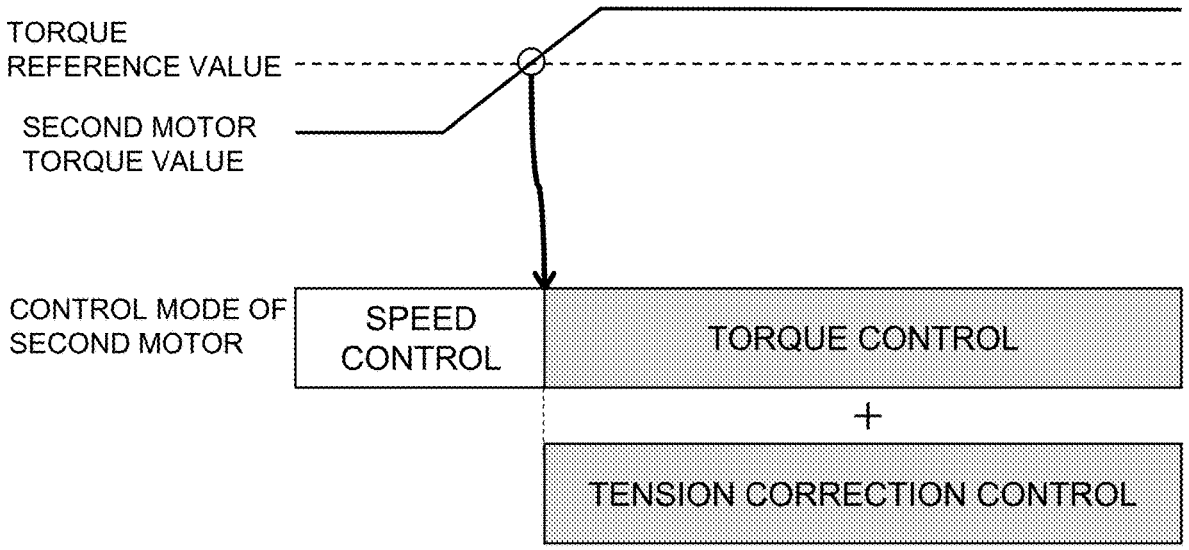
FIG. 4 is a diagram for explaining a specific example of the paper winder according to the embodiment.

As shown in FIG. 4, the controller 100 sets the torque reference value after a driving start of the second motor 22. The torque reference value is a torque value of the first motor 21 at the time when the tension of the paper 50 at the time of winding of the paper 50 by the first winding core 11 is within the target range. The torque value of the first motor 21 used for the setting of the torque reference value may be predetermined data or may be data acquired from the first winding core 11 immediately before the paper 50 is wound by the second winding core 12.

Further, the torque reference value may be a value obtained by adding at least a mechanical loss of the second motor 22 to the torque value of the first motor 21. The mechanical loss means a mechanical loss that depends on rotating speed of a motor. The mechanical loss is different depending on an individual difference of the second motor 22 and is periodically calculated during the driving of the second motor 22. The mechanical loss used for the setting of the torque reference value is periodically updated The controller 100 determines whether the torque value of the second motor 22 is equal to or larger than the torque reference value during the operation of the traverse cutter 40*c*. When determining that the torque value of the second motor 22 is equal to or larger than the torque reference value, as shown in FIG. 4, the controller 100 switches the control mode of the second motor 22 from the speed control to the torque control. Further, as shown in FIG. 4, the controller 100 switches the control mode of the second motor 22 from the speed control to the torque control and performs the tension correction control for the second motor 22.

2-3. Effects

As explained above, in the paper winder 1 according to the embodiment, when the torque value of the second motor 22 is equal to or larger than the torque reference value during the operation of the traverse cutter 40*c*, the control mode of the second motor 22 is switched from the speed control to the torque control and the tension correction control for adjusting the torque value of the second motor 22 such that the tension of the paper 50 falls within the target range is performed. Consequently, it is possible to improve stability of winding of the paper 50 by a new winding core at a replacement time of a winding roll.

3. Processing Example

Figure 5:
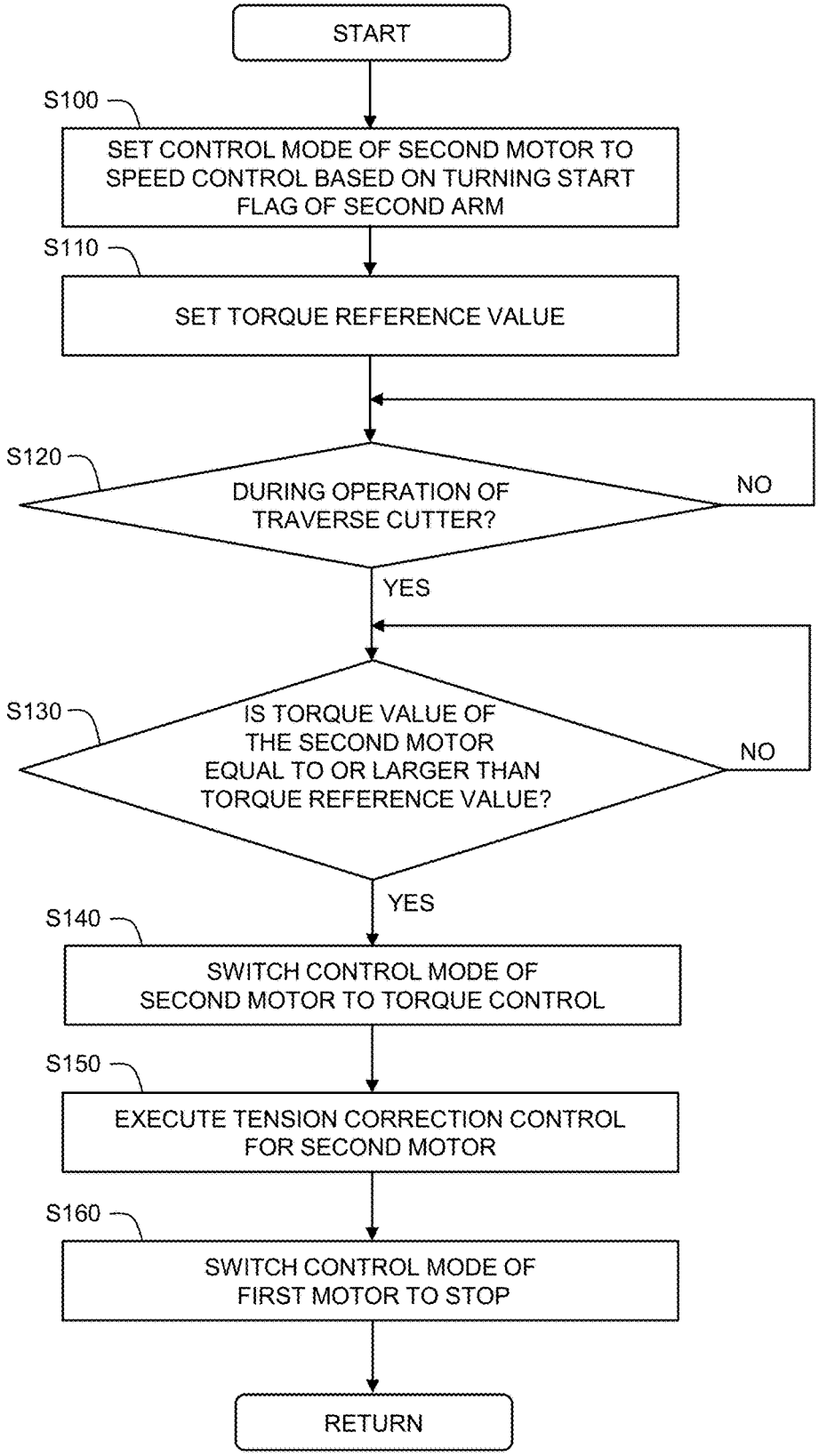
FIG. 5 is a flowchart showing a processing example of the paper winder according to the embodiment.

FIG. 5 is a flowchart showing a processing example of the controller 100 in the paper winder 1 according to the embodiment.

In step S100, the controller 100 sets the control mode of the second motor 22 to the speed control based on the turning start flag of the second arm 10*b*. Thereafter, the processing proceeds to step S110.

In step S110, the controller 100 sets the torque reference value for performing the rotation control for the second motor 22. Thereafter, the processing proceeds to step S120.

In step S120, the controller 100 determines whether the traverse cutter 40*c* is operating. When it is determined that the traverse cutter 40*c* is operating (step S120; Yes), the processing proceeds to step S130. Otherwise (step S120; No), the processing returns to step S120.

In step S130, the controller 100 determines whether the torque value of the second motor 22 is equal to or larger than the torque reference value. When it is determined that the torque value of the second motor 22 is equal to or larger than the torque reference value (step S130; Yes), the processing proceeds to step S140. Otherwise (step S130; No), the processing returns to step S130.

In step S140, the controller 100 switches the control mode of the second motor 22 from the speed control to the torque control. Thereafter, the processing proceeds to step S150.

In step S150, the controller 100 executes the tension correction control for the second motor 22. Thereafter, the processing proceeds to step S160. Note that the processing in step S150 is performed simultaneously with the processing in step S140 explained above.

In step S160, the controller 100 switches the control mode of the first motor 21 from the torque control to the stop.

REFERENCE SIGNS LIST

1 . . . paper winder, 2 . . . paper winding mechanism unit, 3 . . . paper cutting unit, 10 . . . arm unit, 10*a* . . . first arm, 10*b* . . . second arm, 10*c* . . . third arm, 10*d* . . . fourth arm, 11 . . . first winding core, 12 . . . second winding core, 13 . . . guide roller, 21 . . . first motor, 22 . . . second motor, 30 . . . first touch arm, 30*a* . . . rotating shaft, 30*b* . . . nip roll, 40 . . . second touch arm, 40*a* . . . rotating shaft, 40*b* . . . winding core fixture, 40*c* . . . traverse cutter, 50 . . . paper, 60 . . . movable range, 100 . . . controller

The invention claimed is:

1. A paper winder that winds a paper, the paper winder comprising:

a first winding core that is provided in a first arm turning centering on a rotating shaft and on which the paper should be wound;

a first motor that drives the first winding core;

a second winding core that is provided in a second arm turning centering on the rotating shaft and on which the paper should be wound next to the first winding core;

a second motor that drives the second winding core; and a processing circuit that performs rotation control for the first motor and the second motor, wherein the processing circuit is configured to, in the rotation control, after completion of the winding of the paper by the first winding core and after, according to the turning of the second arm, a position of the second winding core has reached a position where the paper should be wound, during an operation of a traverse cutter that cuts the paper near the second winding core, when a torque value of the second motor is equal to or larger than a torque reference value, switch a control mode of the second motor from speed control to torque control and perform tension correction control for adjusting the torque value of the second motor such that tension of the paper falls within a target range, wherein the torque reference value is a torque value of the first motor acquired at a timing immediately before winding of the paper by the second winding core starts, the torque value being acquired while the tension of the paper is within the target range during winding of the paper by the first winding core.

2. The paper winder according to claim 1, wherein the processing circuit is further configured to, in the rotation control, after switching the control mode of the second motor from the speed control to the torque control and after completion of the operation of the traverse cutter, set a control mode of the first motor to stop the driving of the first motor.

3. The paper winder according to claim 1, wherein the torque reference value is a value obtained by adding at least a mechanical loss of the second motor to the torque value of the first motor.

4. The paper winder according to claim 3, wherein the mechanical loss is periodically updated during the driving of the second motor.

5. The paper winder according to claim 1, wherein the processing circuit is configured to set the control mode of the second motor to the speed control when turning of the second arm starts.

6. The paper winder according to claim 1, wherein the processing circuit is configured to determine operation timing of the traverse cutter based on turning start timing of the second arm or forward movement start timing of the first arm.

7. The paper winder according to claim 1, wherein, in the tension correction control, processing circuit is configured to adjust the torque value of the second motor such that the tension of the paper remains within the target range.

8. The paper winder according to claim 1, wherein the first arm includes a nip roll configured to press the paper against an outer circumferential surface of the second winding core before the paper is cut.

9. The paper winder according to claim 8, wherein the traverse cutter cuts the paper at a position near the second winding core while the paper is pressed against the second winding core.

10. The paper winder according to claim 1, wherein the first arm and the second arm are provided as part of an arm structure rotatable about the rotating shaft.

11. The paper winder according to claim 1, further comprising:

a guide roller configured to guide the paper to the first winding core or the second winding core during winding transfer.

12. A paper winder that winds a paper, the paper winder comprising:

a first winding core that is provided in a first arm turning centering on a rotating shaft and on which the paper should be wound;

a first motor that drives the first winding core;

a second winding core that is provided in a second arm turning centering on the rotating shaft and on which the paper should be wound next to the first winding core;

a second motor that drives the second winding core; and a processing circuit that performs rotation control for the first motor and the second motor, wherein the processing circuit is configured to, in the rotation control, after completion of the winding of the paper by the first winding core and after, according to the turning of the second arm, a position of the second winding core has reached a position where the paper should be wound, during an operation of a traverse cutter that cuts the paper near the second winding core, when a torque value of the second motor is equal to or larger than a torque reference value, switch a control mode of the second motor from speed control to torque control and perform tension correction control for adjusting the torque value of the second motor such that tension of the paper falls within a target range, wherein the torque reference value is a value obtained by adding at least a mechanical loss of the second motor to the torque value of the first motor acquired at a timing immediately before winding of the paper by the second winding core starts.

13. The paper winder according to claim 12, wherein the mechanical loss is periodically updated during the driving of the second motor.

14. The paper winder according to claim 12, wherein the processing circuit is further configured to, in the rotation control, after switching the control mode of the second motor from the speed control to the torque control and after completion of the operation of the traverse cutter, set a control mode of the first motor to stop the driving of the first motor.

15. The paper winder according to claim 12, wherein the processing circuit is configured to set the control mode of the second motor to the speed control when turning of the second arm starts.

16. The paper winder according to claim 12, wherein the processing circuit is configured to determine operation timing of the traverse cutter based on turning start timing of the second arm or forward movement start timing of the first arm.

17. The paper winder according to claim 12, wherein, in the tension correction control, processing circuit is configured to adjust the torque value of the second motor such that the tension of the paper remains within the target range.

18. The paper winder according to claim 12, wherein the first arm includes a nip roll configured to press the paper against an outer circumferential surface of the second winding core before the paper is cut.

19. The paper winder according to claim 18, wherein the traverse cutter cuts the paper at a position near the second winding core while the paper is pressed against the second winding core.

20. A paper winding method for winding a paper, comprising:

determining, after completion of winding of the paper by a first winding core that is provided in a first arm turning centering on a rotating shaft and on which the paper should be wound and after a position of a second winding core that is provided in a second arm turning centering on the rotating shaft and on which the paper should be wound next to the first winding core has reached a position where the paper should be wound, during an operation of a traverse cutter that cuts the paper near the second winding core, whether a torque value of a second motor that drives the second winding core is equal to or larger than a torque reference value;

switching a control mode of the second motor from speed control to torque control when it is determined that the torque value of the second motor is equal to or larger than the torque reference value; and performing tension correction control for adjusting the torque value of the second motor such that tension of the paper falls within a target range, wherein the torque reference value is a torque value of the first motor acquired at a timing immediately before winding of the paper by the second winding core starts, the torque value being acquired while the tension of the paper is within the target range during winding of the paper by the first winding core.

* * * * *